US007281977B2

(12) United States Patent
Jones

(10) Patent No.: US 7,281,977 B2
(45) **Date of Patent: *Oct. 16, 2007**

(54) GAMING DEVICE PROVIDING TOUCH ACTIVATED SYMBOL INFORMATION

(75) Inventor: Aaron T. Jones, Reno, NV (US)

(73) Assignee: IGT, Reno, NV (US)

( * ) Notice: Subject to any disclaimer, the term of this patent is extended or adjusted under 35 U.S.C. 154(b) by 249 days.

This patent is subject to a terminal disclaimer.

(21) Appl. No.: 11/156,009

(22) Filed: Jun. 17, 2005

(65) Prior Publication Data

US 2005/0233800 A1 Oct. 20, 2005

Related U.S. Application Data

(63) Continuation of application No. 09/680,349, filed on Oct. 5, 2000, now Pat. No. 6,939,223.

(51) Int. Cl.
*A63F 9/22* (2006.01)

(52) U.S. Cl. ..... 463/16; 463/20; 345/705; 345/708

(58) Field of Classification Search ..... 463/16, 463/20, 30

See application file for complete search history.

(56) References Cited

U.S. PATENT DOCUMENTS

| | | | |
|---|---|---|---|
| 4,695,053 | A | 9/1987 | Vazquez, Jr. et al. |
| 4,991,848 | A | 2/1991 | Greenwood et al. |
| 5,046,736 | A | 9/1991 | Bridgeman et al. |
| 5,157,768 | A | 10/1992 | Hoeber et al. |
| 5,287,448 | A | 2/1994 | Nicol et al. |
| 5,342,047 | A | 8/1994 | Heidel et al. |
| 5,363,482 | A | 11/1994 | Victor et al. |
| 5,542,669 | A | 8/1996 | Charron et al. |
| 5,687,333 | A | 11/1997 | Dobashi et al. |
| 5,715,415 | A | 2/1998 | Dazey et al. |
| 5,766,074 | A | 6/1998 | Cannon et al. |

(Continued)

FOREIGN PATENT DOCUMENTS

| | | |
|---|---|---|
| WO | WO9800207 | 1/1998 |

OTHER PUBLICATIONS

Red, White & Blue Article (illustrating pay table on glass) published by Strictly Slots, Jul. 2000.

(Continued)

*Primary Examiner*—Corbett B. Coburn
(74) *Attorney, Agent, or Firm*—Bell, Boyd & Lloyd LLP

(57) ABSTRACT

An apparatus and method for quickly and easily providing desired paytable information to a player of a gaming device. The invention utilizes the game's display device containing a plurality of game generated symbols as an index of symbols from which a player can choose a desired symbol. The present invention enables a player to touch or otherwise select the desired symbol and produce desired paytable information, which includes a plurality of different types of information. Touching a desired symbol is simple, interactive and entertaining. Such features are not inherent in the existing methods. The invention contemplates the game maintaining one or more databases for every single symbol. Alternatively, the game can maintain one or more databases having information on all the symbols of the gaming device and immediately scroll to the desired symbol upon the player's selection.

42 Claims, 8 Drawing Sheets

U.S. PATENT DOCUMENTS

| | | | |
|---|---|---|---|
| 5,833,537 | A | 11/1998 | Barrie |
| 5,851,147 | A | 12/1998 | Stupak et al. |
| 5,967,893 | A | 10/1999 | Lawrence et al. |
| 5,967,894 | A | 10/1999 | Kinoshita et al. |
| 5,984,779 | A | 11/1999 | Bridgeman et al. |
| 6,015,346 | A | 1/2000 | Bennett |
| 6,056,642 | A | 5/2000 | Bennett |
| 6,068,552 | A | 5/2000 | Walker et al. |
| 6,071,192 | A | 6/2000 | Weiss |
| 6,149,156 | A | 11/2000 | Feola |
| 6,155,925 | A | 12/2000 | Giobbi et al. |
| 6,208,338 | B1 | 3/2001 | Fischer et al. |
| 6,209,006 | B1 | 3/2001 | Medl et al. |
| 6,236,989 | B1 | 5/2001 | Mandyam et al. |
| 6,270,410 | B1 | 8/2001 | DeMar et al. |
| 6,373,502 | B1 | 4/2002 | Nielsen |
| 6,375,568 | B1 | 4/2002 | Roffman et al. |
| 2002/0002073 | A1 | 1/2002 | Montgomery et al. |
| 2002/0004424 | A1 | 1/2002 | Nelson et al. |

OTHER PUBLICATIONS

Laura Lemay, Teach Yourself Web Publishing in HTML4, 1999, Sams Publishing, pp. 10-12, 45-47, 76-82, 107-114, 557-559.

Marshall Fey, Slot Machines, A Pictorial History of the First 100 Years, Liberty Belle Books, 1983, 43.

Screen Shots of Example Pay Table Button on Screen published by IGT, Undated.

Screen Shots of Example Pop-Up Pay Table published by IGT, Undated.

Screen Shot of Example Video Poker "Held" Message published by IGT, Undated.

GAMING DEVICE PROVIDING TOUCH ACTIVATED SYMBOL INFORMATION

PRIORITY CLAIM

This application is a continuation of, claims priority to and the benefit of U.S. patent application Ser. No. 09/680,349 filed on Oct. 5, 2000, now U.S. Pat. No. 6,939,223, the entire contents of which is incorporated herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having symbols, wherein a player can touch a symbol and receive information concerning said symbol and other pay information.

BACKGROUND OF THE INVENTION

Gaming device manufactures have long provided gaming machines employing a plurality of reels, wherein the reels each have a plurality of symbols. In these games, the player spins the reels which act independently to produce a random generation of a combination of symbols. If the generated combination, or a portion of the combination, matches one of a number of predetermined award producing or winning combinations, the player receives an award.

To increase player enjoyment and excitement, and to increase the popularity of the gaming machines, gaming device manufacturers constantly strive to provide players with new types of gaming machines that attract the player and keep the player entertained. One proven way manufacturers use to make their machines more popular is to increase the number and variety of winning combinations and provide more opportunities for the player to win. Providing more variety and opportunities holds the player's interest for a longer time and also enables the manufacturer to have a larger range of payouts for winning combinations. The larger range increases the size of the largest possible payout of the gaming device, and larger payouts tend to attract players.

To increase variety and opportunity, manufacturers have increased the number of possible symbol positions or paystops. Increasing paystops increases the number of different symbols a game can have and increases the number of times a particular symbol can appear. Increasing the number of times that a symbol can appear increases its likelihood of appearance, which affects the payout of a winning combination containing that symbol. Winning combinations that have a rare or low likelihood of appearance tend to have higher payouts.

One way manufactures have increased the number of paystops has been to increase the size of the reel to accommodate more stops. Original gaming machines had approximately ten stops per reel, modern mechanical reels have approximately thirty to thirty five stops per reel and modern video machines have no physical limit to the number of stops per reel. Another way manufacturers have increased the number of paystops has been to add reels. Original gaming machines had three reels, while modern mechanical machines have employed up to five reels. Video reel machines have not increased the number of reels past five mainly because five reels create enough diversity to keep the game interesting without becoming too complex for the player to enjoy.

It should be appreciated that gaming machines have become rather complex in comparison to the original three reel, ten stop machine created before 1900. It is well known in the art for the manufacturer to provide pay information on a paytable in accordance with regulation. That is, manufacturers provide a list or paytable containing all the different winning combinations of symbols and the awards associated therewith. Such paytables historically and sometimes still appear on the front face of the gaming machine, such as on the glass in a top cabinet of the machine. However, with more complex video games having multiple paying combinations and different machine configurations, it is not possible to display all necessary information on glass. Therefore, paytables on video machines are also available through player assistance or help screens as is well known in the art. The known help screens, however, do not provide an intuitive or convenient way to display the paytables.

With multiple paylines on simulated displays, which can have any number of simulated reels and an infinite number of different symbols and symbol combinations, the paytables will accordingly have many symbols and symbol combinations to keep track of. The rapid development of complex games has created a need for an easy method for displaying information on a particular symbol, so that a player can learn its function within the game. Games can structure the symbol combinations to pay from left to right, right to left, or in any position on a line, etc. The symbols can also have special functions such as substituting for another symbol, multiplying wins, or triggering a bonus event. Given the spatial limitations of the simulated displays in which the game preferably displays the paytable, paytables often comprise multiple display screens.

Players, in general, wish to play the game and not read paytables. However, players want to know why they won and how much certain combinations pay. Players most likely do not desire to digest an entire paytable; rather, they want to find a particular symbol or combination or find all the winning combinations associated with a particular symbol. It is therefore desirable to provide the information that the player wants rather than requiring a player to scroll through pages of information. No known gaming device provides a quick and easy method for enabling the player to sort through unwanted paytable symbols and combinations to find a desired symbol or combination.

SUMMARY OF THE INVENTION

The present invention provides an apparatus and method for quickly and easily displaying desired paytable information to a player of a gaming device. In accordance with the present invention, it is likely that a player desires paytable or other information regarding a symbol or combination displayed on the display device; therefore, the display device serves as an excellent index of symbols and combinations of symbols for which a player may likely desire paytable or other information. The present invention enables a player to touch any one of the displayed symbols to obtain desired paytable information. Hereinafter, "paytable information" refers to the pay for particular symbols and combinations of symbols as well as other desired information, such as bonus round information involving a certain symbol or combination.

In one embodiment of the present invention, the controller of the gaming device stores one or more paytables of information for each and every individual symbol contained on the reels of the gaming device. The display device displays the stored information when the player touches the symbol. The controller of the gaming device preferably stores all paytable information associated with each symbol including, but not limited to: (i) base game pays of the symbol or any combination containing the symbol; (ii) bonus round information such as triggering combinations containing the symbol; (iii) multiplier information involving the symbol; (iv) substitute information involving the symbol; and (v) scatter pay information involving the symbol. The embodiment can maintain the different forms of paytable information for a selected symbol on one or more screens or displays.

In an alternative embodiment, the controller of the gaming device stores one or more paytables, wherein each paytable contains information on every and all the symbols. In one example, a single all encompassing paytable stores all information for all symbols including, but not limited to: (i) base game pays of all symbols and combinations; (ii) bonus round information such as all triggering symbols and combinations; (iii) all multiplier information; (iv) all substitute information; and (v) all scatter pay information. In another example of the alternative embodiment, a plurality of partially encompassing paytables store information on all of the symbols for one or more, but not all of the types of paytable information.

In the alternative embodiment, when the player touches a symbol, the game automatically and immediately scrolls through one of the encompassing paytables to the area of the paytable containing the selected information and commands the display device to display the selected area. When multiple encompassing displays contain one or more types of paytable information, the present invention scrolls to and enables the player view each of the areas of each of the types of information containing the selected information.

It is therefore an object of the present invention to provide a gaming device having touch activated symbol or other paytable information.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1:
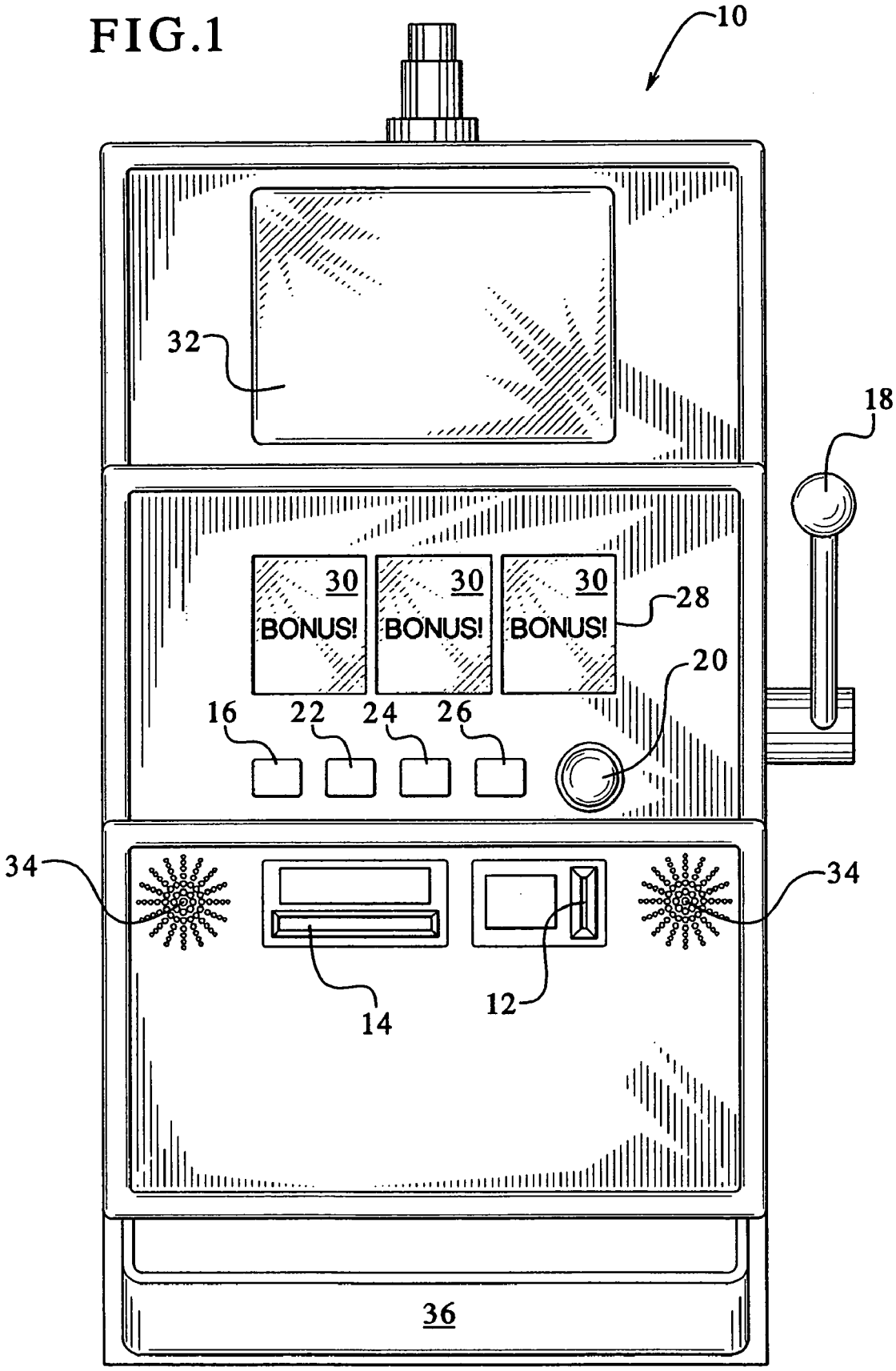
FIG. 1 is a front plan view of a general embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) that a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform. Gaming device 10 can incorporate any game such as slot, poker or keno. The symbols used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. The present invention preferably employs or uses credits, however, the present invention is not limited to the use of credits and contemplates employing other units of value such as money. For purposes of describing and claiming this invention, the term "credit" includes any unit of value such as a gaming device credit or actual money.

After depositing the appropriate amount of money, a player can begin the game by pulling arm 18 or by pushing play button 20. Play button 20 can be any play activator used by the player which starts any game or sequence of events in the gaming device.

Referring to FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a paystop display 28 which contains a plurality of reels 30, preferably three to five reels and preferably in video form. Gaming device 10 can also be in mechanical form, wherein a separate video display contains the paytable of the present invention. Each reel 30 displays a plurality of symbols such as bells, hearts, martinis, fruits, cactuses, numbers, cigars, letters, bars or other images, which preferably correspond to a theme associated with the gaming device 10. If the reels 30 are in video form, the gaming device 10 preferably displays the video reels 30 in a display device described below. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards that keep track of the player's credits.

With respect to electronics, the controller of gaming device 10 preferably includes the electronic configuration generally illustrated in FIG. 2, which has: a processor 38; a memory device 40 for storing program code or other data; a display device 32 (i.e., a liquid crystal display) described below; a plurality of speakers 34; and at least one input device as indicated by block 33. The processor 38 is preferably a microprocessor or microcontroller-based platform that is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code, which controls the gaming device 10 so that it plays a particular game in accordance with applicable game rules and paytables.

Figure 2:
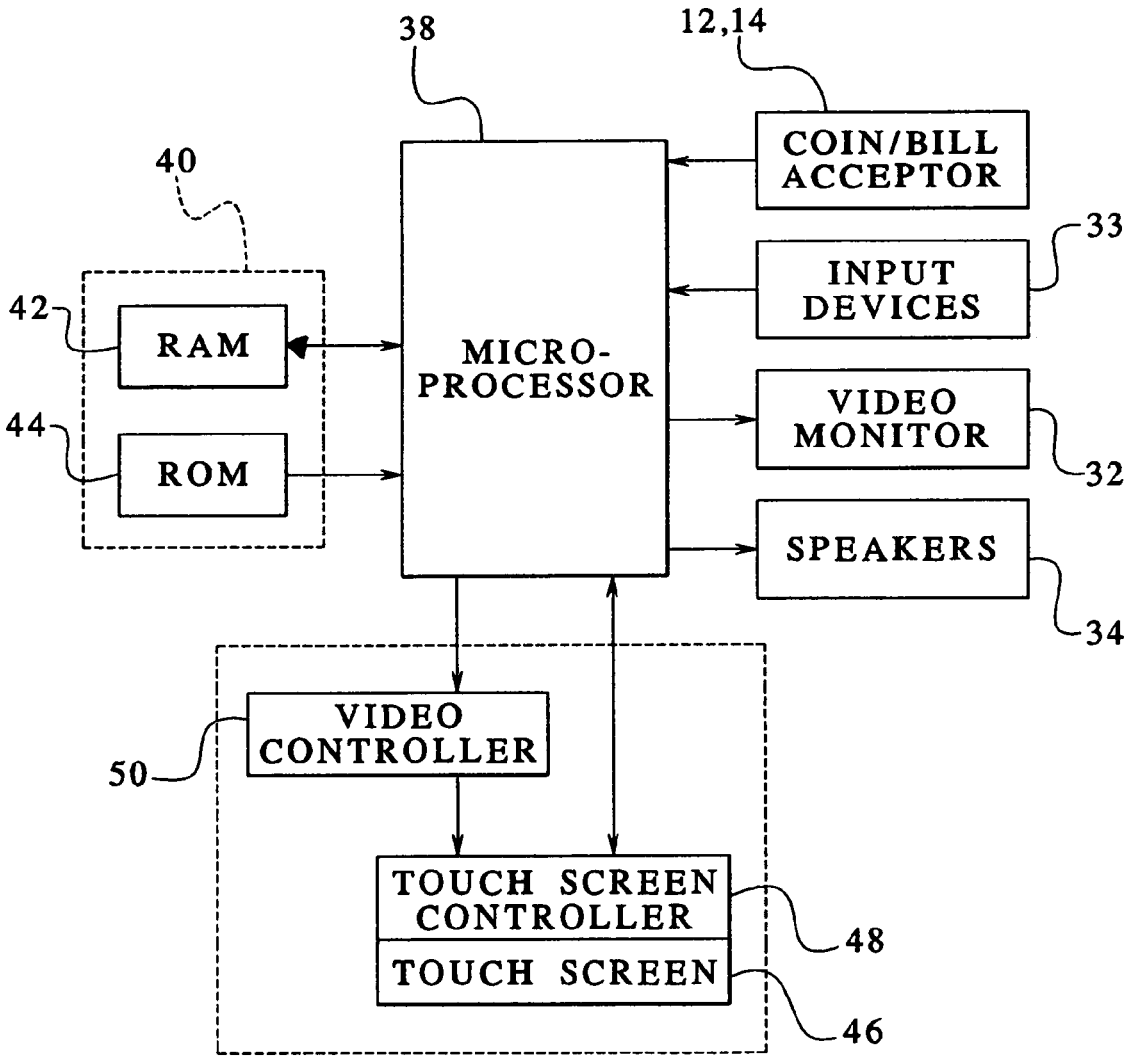
FIG. 2 is a schematic block diagram of the electronic configuration of one embodiment of the gaming device of the present invention.

As illustrated in FIG. 2, the player preferably uses the input devices 33, such as the arm 18, play button 20, the bet one button 24 and the cash out button 26 to input signals into gaming device 10. The present invention preferably employs a touch screen 46 and an associated touch screen controller 48. Touch screen 46 and touch screen controller 48 are connected to a video controller 50 and processor 38. The display device can alternatively not contain a touch screen 46 or a touch screen controller 48. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. For purposes of describing the invention, the controller includes the processor 38 and memory device 40.

Referring to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, gaming device 10 also preferably gives players the opportunity to win credits in a bonus round. This type of gaming device 10 will include a program that will automatically begin a bonus round when the player has achieved a qualifying condition in the game. This qualifying condition can be a particular arrangement of indicia on the display window 28. The gaming device 10 also includes a display device such as a display device 32 shown in FIG. 1 enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS!" appearing in the same location on three adjacent reels.

Referring still to FIG. 1, the present invention of the gaming device 10 is largely embodied in a display device 32 except for certain peripheral input devices 33, described below, which are either mounted to the gaming device or remote from the gaming device. The remainder of the description proceeds as follows: (i) a description of the different apparatus and methods for activating the bonus round is provided; (ii) a description of the different embodiments of the paytable display is provided; and (iii) a description of the different apparatus and methods for selecting different paytables is provided.

Activating the Paytable Displays

Figure 3:
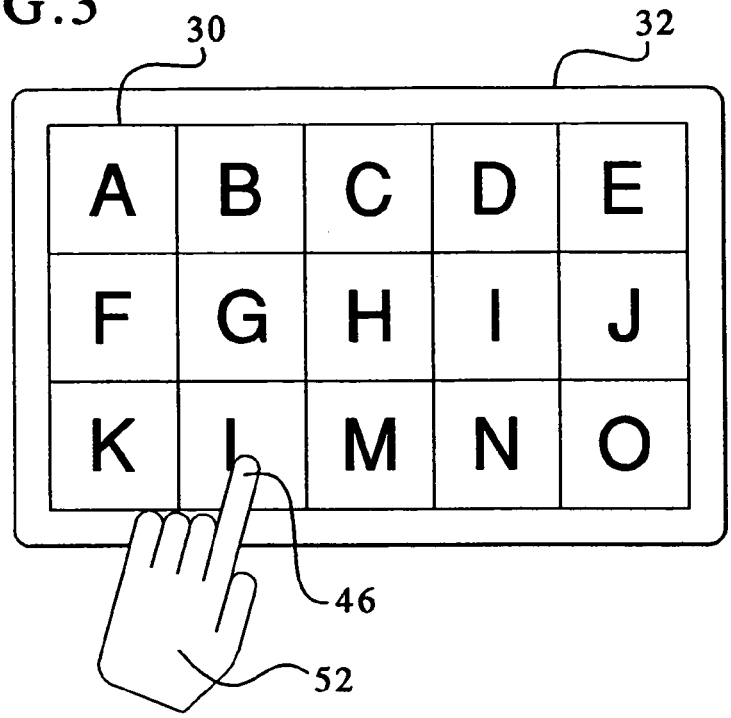
FIG. 3 is a front elevational view of the display device illustrating a touch screen embodiment for activating the paytable information of the present invention.

Referring now to FIG. 3, a front plan view of the display device 32 illustrating a touch screen method of activating the paytable information is shown. After the reels 30 spin and stop, the display device 32 displays a plurality of symbols, shown generally as symbols "A" through "O". The present invention enables the player to access all paytable information concerning the symbols "A" through "O" displayed on the display device 32.

FIG. 3 illustrates the preferred embodiment for activating the paytable display, wherein the display device 32 includes a touch screen 46 and touch screen controller (not shown), as described above. It is well known in the art to include touch screens in gaming devices. The game preferably makes the symbols "A" through "O" separate, selectable input devices 33 via the touch screen 46 interface. Selecting the area displaying the "A" symbol sends a different input to the controller than does selecting the "H" symbol or "N" symbol. Each symbol can thereby invoke or activate a separate paytable. When the player 52 touches or selects a symbol, such as the symbol "L" as illustrated in FIG. 3, the game activates and displays the appropriate paytable. The different paytable embodiments are described in detail below.

Figure 4:
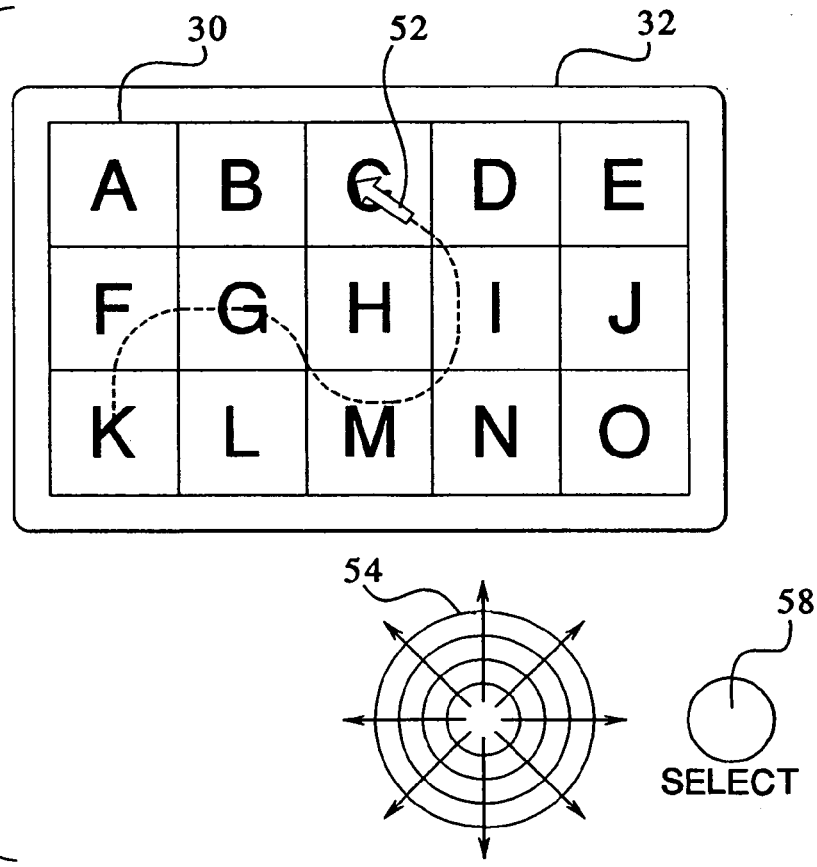
FIG. 4 is a front elevational view of the display device and an external roller which illustrates a roller and cursor embodiment for activating the paytable information of the present invention.

Referring now to FIG. 4, a front elevation view of the display device 32 and an external roller 54 are shown illustrating the roller and cursor embodiment for activating the paytable information. This embodiment does not require a touch screen 46 and an associated touch screen controller, however the embodiment can contain such devices. The display device 32 can be any known video monitor, television screen, dot matrix display, CRT, LED, LCD or electroluminescent display. The display device 32 can be color or monochrome although, preferably, the display is color.

The embodiment of FIG. 4 preferably includes a roller 54, which can move a cursor 56 around different areas of the display device, so that the cursor 56 can "land on" and thereby select one of the symbols, such as symbols "A" through "O". The roller 54 can be any type of digital input device such as a mouse, a joystick or even a plurality of maintainable pushbuttons, wherein each pushbutton maintains a different direction. The roller 54 can alternatively be a light pen, which is known in the art. A light pen device works in conjunction with a video monitor adapted to be contacted by the light pen. The player presses the light pen onto a desired area or symbol of the video monitor 32. The light pen emits a light pulse, which the display device can detect, so that the coordinates of the light pen on the display device can be determined. FIG. 4 shows a roller ball 54, such as the type commonly found on video game machines, which can be mounted directly to the panel of the gaming device 10.

The cursor 56 is preferably a conventional arrow as is commonly used in commercially available software. Software adapted to simulate the cursor preferably enables the player to manipulate the cursor 56 to any area on the display device 32 within the boundary created by the reels 30 and the symbols "A" through "O". That is, the player preferably cannot move the cursor outside of the reels onto extraneous indicia and/or selectors.

FIG. 4 also illustrates a selector 58. The selector 58 can be an area of a touch screen 46 adapted to send an input to the controller. The selector 58 can also be an external input device 33 mounted on the panel of the gaming device 10. When the player selects the selector 58, the game activates the symbol, e.g., "A" through "O", upon which the cursor points. The cursor accordingly does not preferably point to two separate symbols simultaneously. The player can thus quickly activate the pay table display for any symbol by rotating the roller 54 so that the cursor 56 lays upon a desired symbol, whereupon the player selects the selector 58.

Figure 5:
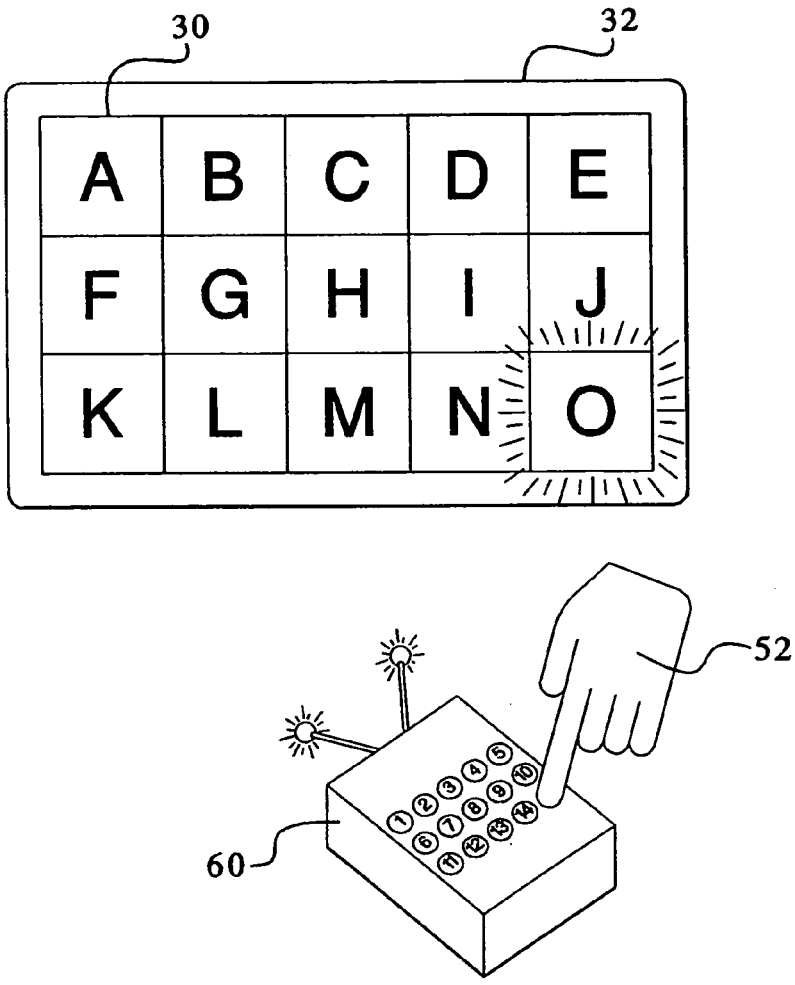
FIG. 5 is a front elevational view of the display device and a separate perspective view of a remote control device illustrating a remote embodiment for activating the paytable information of the present invention.

Referring now to FIG. 5, a display device 32 and a separate remote control device 60 are shown illustrating a remote control embodiment for activating the paytable information. As with the roller and cursor embodiment, the remote control embodiment of FIG. 5 does not require a touch screen 46 and an associated touch screen controller, however the embodiment can contain such devices. The display device 32 can likewise be any known video monitor, television screen, dot matrix display, CRT, LED, LCD or electro-luminescent display.

The remote control device 60 can be any known device, employing any known signal frequencies, for sending a plurality of remote signals to the gaming machine. FIG. 5 illustrates the control device containing fifteen selectors, one selector for each symbol on the reels 30 of the display device 32. The player 52 is shown selecting the 15th selector of the control device 60, which corresponds to the "O" symbol of the display device 32. Using this method, the player can activate the pay table display for any symbol by selecting the selector on the control device 60 corresponding to the desired symbol "A" through "O".

The remote control embodiment is preferably employed when the gaming device 10 is a pub-style table-top game (not shown) that a player operates while sitting or standing some distance from the gaming device. The present invention is particularly useful in such a situation because the player may not have the ability to select or see an entire pay table for every symbol but nevertheless requires pay table information. It should be appreciated that the scope of the present invention is not limited to the examples illustrating the three activation embodiments discussed, wherein variations in the disclosed apparatus can achieve the same result using the methods disclosed.

PAYTABLE EMBODIMENTS

Figure 6:
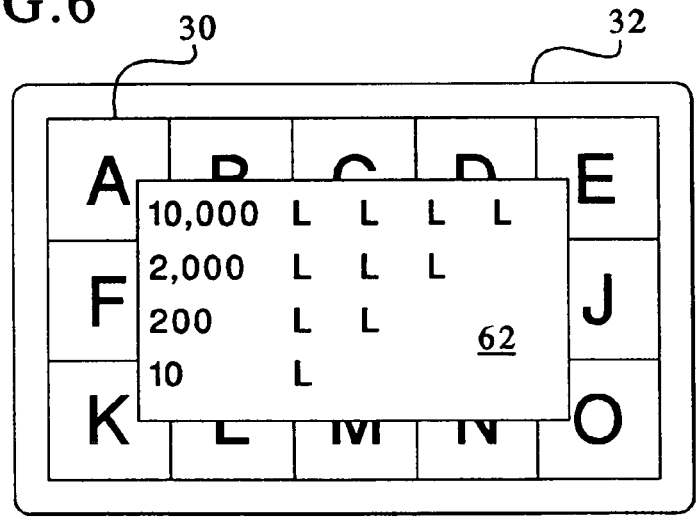
FIG. 6 is a front elevational view of the display device illustrating one example of the configuration and spatial relationship of the paytable display relative to the gaming device.

Referring now to FIG. 6, a front elevation view of the display device 32 illustrating one example of the configuration and spatial relationship of a paytable display 62 relative to the gaming device 32 is shown. When the player activates a symbol (through a suitable activation method), the gaming device activates and displays a paytable display, such as paytable display 62. FIG. 6 illustrates a preferred embodiment, wherein the game places the display in a relatively central location on the display device 32.

As illustrated in FIG. 6, the game preferably does not employ a second display device such as display device 28. Alternatively, the game can place the paytable display 62 in a secondary display device. The game can utilize a portion or all of the display device 32 and can place the paytable display 62 in any portion of the gaming device. The game can call forth the paytable display 62 in the same location, regardless of the position of the chosen symbol. Alternatively, the game can selectively place the paytable display closer to the chosen symbol.

The game can maintain the display of the underlying indicia, e.g. the symbols "A" through "O", and other game theme indicia. Alternatively, the game can blank-out or provide no background or underlying indicia and thus highlight the paytable displays. The game suitably differentiates the paytable display 62 from the reels 30 and associated symbols, so that a player can easily read and understand the information contained in the paytable display. The game can additionally provide an audio production through the speakers 34, which provides or otherwise discloses the information of the paytable display 62. Alternatively, or in addition to the display 62 and/or the audio production, the present invention contemplates providing a video animation or motion picture production in conjunction with the information disclosure. Such a dynamic visual display increases the player's entertainment and enjoyment.

Figure 7:
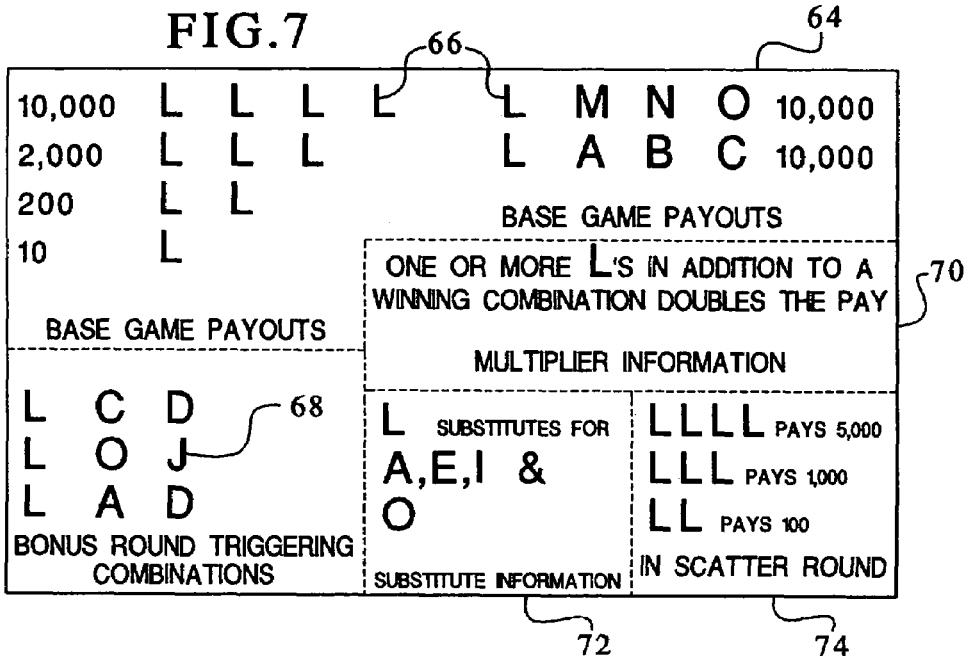
FIG. 7 is a front elevational view of the paytable display illustrating one paytable embodiment, wherein a separate display includes all information pertaining to a single symbol of the gaming device of the present invention.

Referring now to FIG. 7, a front elevation view of the paytable display 64 is shown illustrating a first paytable embodiment, wherein a single display includes all information pertaining to a single symbol of the gaming device of the present invention. The paytable 64 contains five types of paytable or pay information concerning a particular symbol, namely: (i) base game payouts 66 of the symbol or any combination containing the symbol; (ii) bonus round information 68 such as triggering combinations containing the symbol; (iii) multiplier information 70 involving the symbol; (iv) substitute information 72 involving the symbol; and (v) scatter pay information 74 involving the symbol.

It should be appreciated that the paytable display 64 can provide more, or less information and is not limited to providing the information described herein. Base game pay information 66 preferably includes "of a kind" information, such as the pay for obtaining an "L, L" or "L, L, L, L". Base game pay information 66 also preferably includes combination information such as the pay for obtaining combinations including an "L" such as the "L, M, N, O" shown in the paytable 64.

Bonus round information 68 preferably includes all symbol combinations including the selected symbol that will trigger a bonus round or bonus event. The paytable 64 illustrates three combinations having the selected symbol "L" that will trigger a bonus round. It should be appreciated that a single "L" symbol or other "of a kind" combination can also trigger a bonus round. Bonus round information 68 is not limited to triggering combinations. If a symbol is used in the bonus round, bonus round information 68 can also include bonus pay information involving the symbol (e.g., base game pay information 66 format but involving the bonus round).

Multiplier information 70 includes all information about the selected symbol and combinations including the symbol, wherein the symbol or combination having the symbol causes the game to multiply the pay of a winning combination. For example, paytable 64 discloses that one or more "L's" in addition to a winning combination doubles the pay of the combination. Multiplier information 70 can include many variations from the above example. For instance, obtaining an "L" as part of a winning combination, as opposed to in addition to the combination, can multiply the pay of the combination. The multiplier can likewise be 3×, 4×, etc.

Substitute information 72 includes all information about a selected symbol involving the symbol's ability to substitute for other symbols in winning combinations. For example, the paytable 64 discloses that an "L" symbol can substitute for an "A", "E", "I", and "O" symbol, where these symbols, in a defined combination, produce a base game award. Scatter pay information 74 includes all information about a selected symbol that is specific to a scatter pay. In a scatter pay, the game pays the player for any winning combinations that appear on the reels either in the display window 28 or on the display device 30. That is, the winning combinations do not have to occur on a defined payline. The winning combinations can occur in any configuration on the displayed symbols, even vertical combinations (i.e., two symbols of the same reel).

Symbols or combinations can operate the same in a scatter round as they do in the regular base game. Alternatively, symbols or combinations can act differently, and such differences create scatter pay information 74. For example, referring to the paytable 64, an "L, L, L, L" combination normally pays 10,000 credits, as shown in the base game information 66. In the scatter round, an "L, L, L, L" combination pays 5,000 credits, as shown in the scatter pay information 74. It should be appreciated that the implementor can create any difference according to the overall math of the machine and is not limited to lessening the pay as shown.

Paytable 64 of FIG. 7 provides all pertinent information, described above, for a single symbol. It should be appreciated that the implementor can provide more or less types of information than the types described above. The game preferably stores a paytable 64 for each symbol. When a player activates a symbol, e.g., touches it, the game displays the appropriate paytable. The paytables 64 will contain overlapping information. A winning combination "L, M, N, O" will appear in each of the constituent paytables.

Figure 8A:
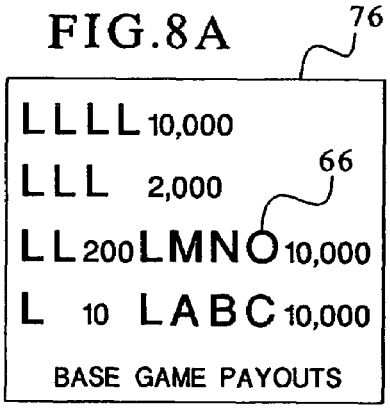
FIG. 8A is a front elevational view of the paytable display illustrating a second paytable embodiment, wherein a separate display includes base game pay information for a single symbol of the gaming device of the present invention.
Figure 8B:
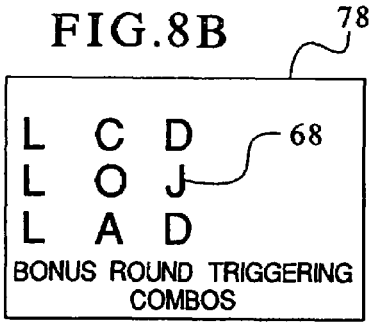
FIG. 8B is a front elevational view of the paytable display illustrating a second paytable embodiment, wherein a separate display includes bonus round triggering information for a single symbol of the gaming device of the present invention.
Figure 8C:
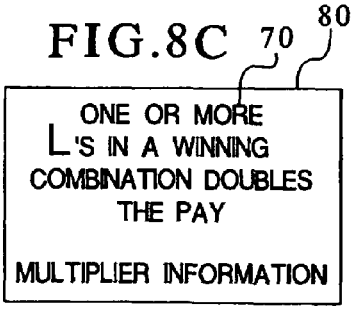
FIG. 8C is a front elevational view of the paytable display illustrating a second paytable embodiment, wherein a separate display includes multiplier information for a single symbol of the gaming device of the present invention.
Figure 8D:
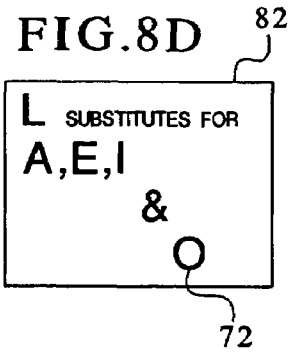
FIG. 8D is a front elevational view of the paytable display illustrating a second paytable embodiment, wherein a separate display includes substitute information for a single symbol of the gaming device of the present invention.
Figure 8E:
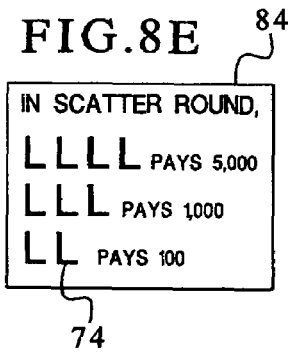
FIG. 8E is a front elevational view of the paytable display illustrating a second paytable embodiment, wherein a separate display includes scatter information for a single symbol of the gaming device of the present invention.

Referring now to FIGS. 8A through 8E, a second paytable embodiment is shown, wherein a paytable display includes less than all information for a single symbol. In this embodiment, the game maintains a plurality of paytables for a single symbol. For example, FIG. 8A illustrates the paytable 76 which includes only base game pay information 66 for the single symbol "L". FIG. 8B illustrates the view of the paytable 78 which includes only bonus round information 68 for the single symbol "L". FIG. 8C illustrates the paytable 80 which includes multiplier information 70 for the single symbol "L". FIG. 8D illustrates the paytable 82 which includes substitute information 72 for the single symbol "L". FIG. 8E illustrates the paytable 84 which includes scatter information 74 for the single symbol "L".

The embodiment illustrated by FIGS. 8A through 8E is not limited to displaying only one type of information on a single paytable display. For example, one paytable display can contain base game pay information 66, and multiplier information 70 for the symbol "L", while a second paytable display contains bonus round information 68, substitute information 72 and scatter information 74. The implementor can create any number of paytable displays having any combination of desired types of information. Preferably, the combinations together comprise each of the types of paytable information. This embodiment differs from the last in that there is more than one display for a single symbol.

Figure 9:
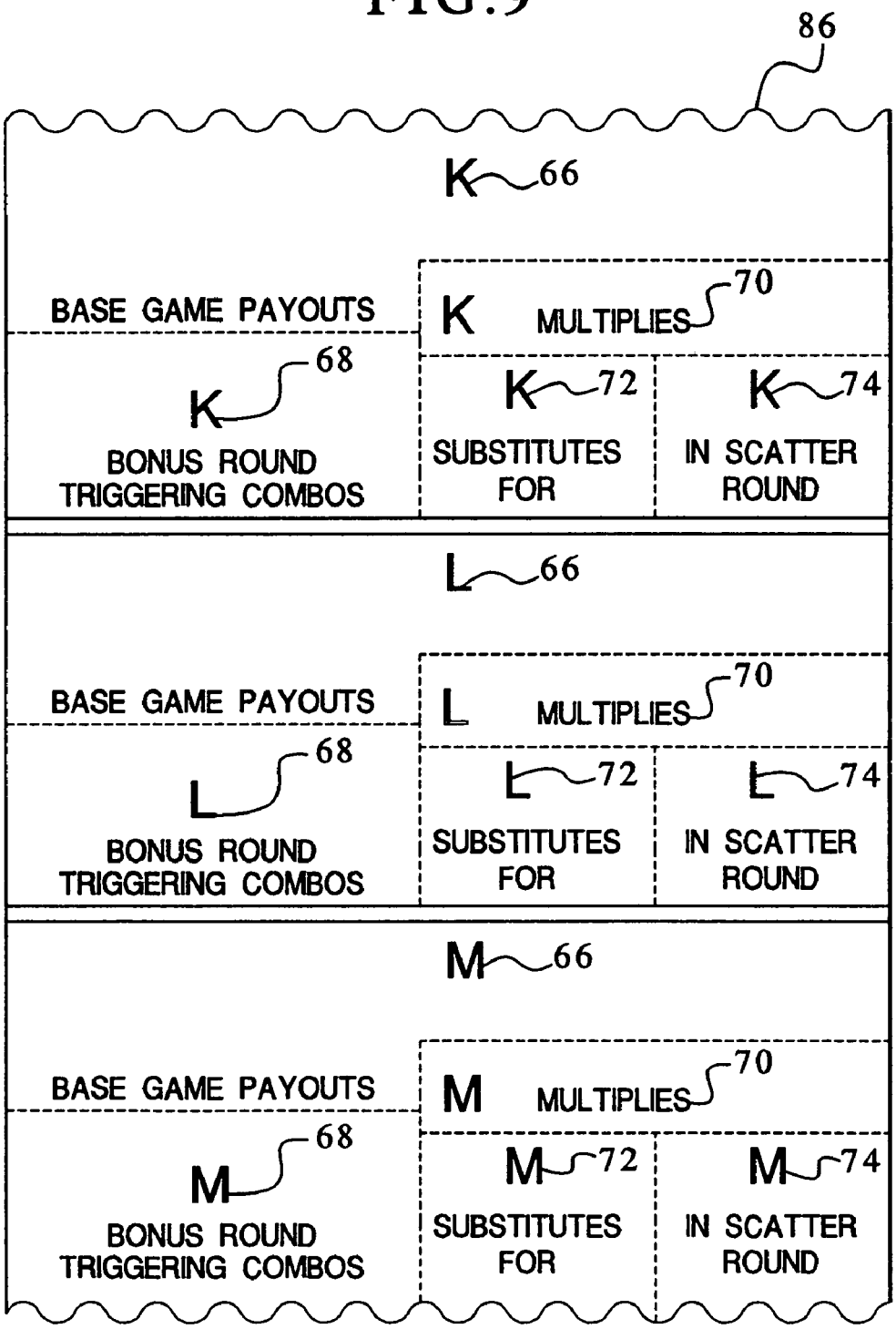
FIG. 9 is a fragmentary front elevational view of the paytable display illustrating a third paytable embodiment, wherein a single display includes all information for all symbols of the gaming device of the present invention.

Referring now to FIG. 9, a fragmentary front elevation view of the paytable display 86 is shown illustrating a third paytable embodiment, wherein a single display includes all information for all symbols of the gaming device. The embodiment illustrated by FIG. 9 includes the well known method of having one display containing all paytable information for every symbol. Such paytables in today's games can be up to ten pages or screens deep, which requires the player to spend a good deal of time looking for the desired information. However, when the player inputs a request for obtaining paytable information on a specific symbol to the gaming device of the present invention (e.g. through the methods described above), the game immediately scrolls to and displays the desired section of the paytable.

Figure 10A:
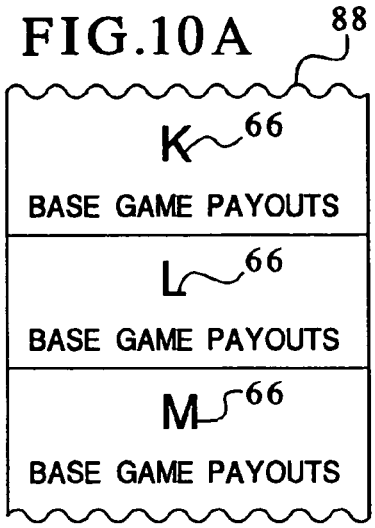
FIG. 10A is a fragmentary front elevational view of the paytable display illustrating a fourth paytable embodiment, wherein a separate display includes base game pay information for all symbols of the gaming device of the present invention.
Figure 10B:
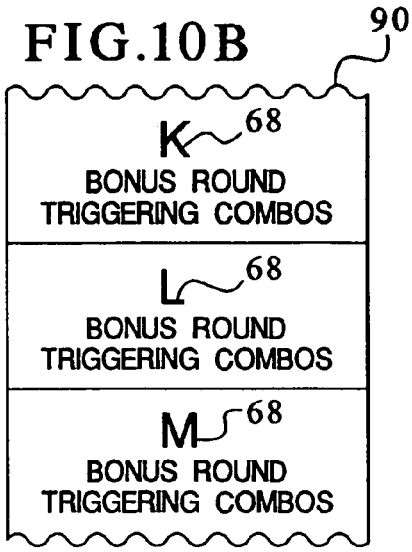
FIG. 10B is a fragmentary front elevational view of the paytable display illustrating a fourth paytable embodiment, wherein a separate display includes bonus round triggering information for all symbols of the gaming device of the present invention.
Figure 10C:
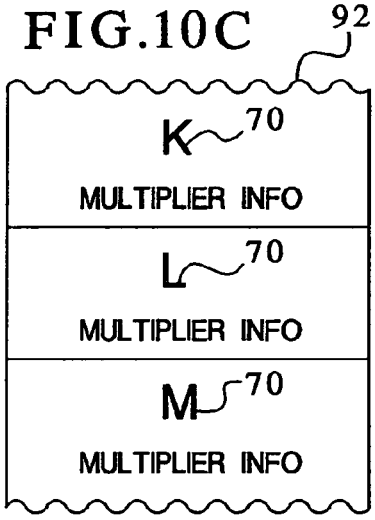
FIG. 10C is a fragmentary front elevational view of the paytable display illustrating a fourth paytable embodiment, wherein a separate display includes multiplier information for all symbols of the gaming device of the present invention.
Figure 10D:
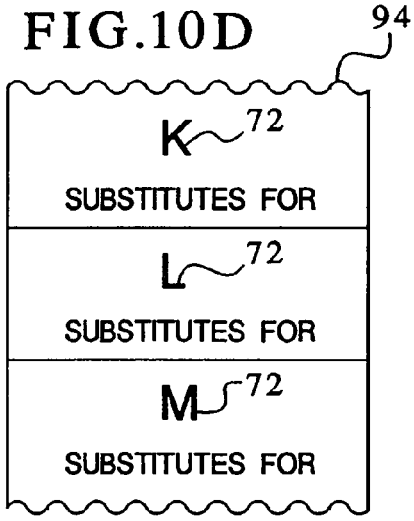
FIG. 10D is a fragmentary front elevational view of the paytable display illustrating a fourth paytable embodiment, wherein a separate display includes substitute information for all symbols of the gaming device of the present invention.
Figure 10E:
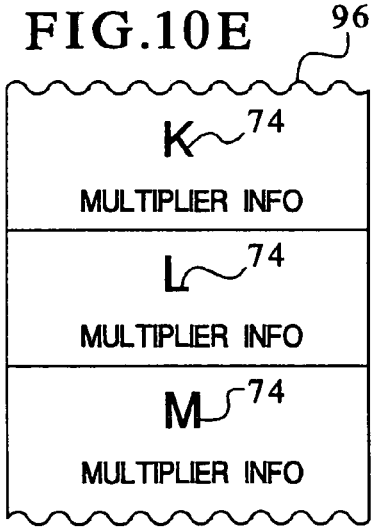
FIG. 10E is a fragmentary front elevational view of the paytable display illustrating a fourth paytable embodiment, wherein a separate display includes scatter information for all symbols of the gaming device of the present invention.

FIG. 9 illustrates the paytable 86, which contains all types of information for all symbols of the gaming device 10. The fragmentary view shows a representation of the information areas 66, 68, 70, 72 and 74 for the symbols "K", "L", and "M". The game preferably only displays the desired information, e.g., the symbol "L", onto the display device 32 (not shown). This is, the information for the symbols "K" and "M" is shown here to illustrate that the overall paytable containing more than one symbol. The portion displayed on the display device 32 only preferably includes the "L" information. The game can alternatively additionally display a portion or all of the information for neighboring symbols such as "K" and "M" onto the display device 32. The game can immediately display paytable information for the symbol "L" or provide a desirable effect, such as showing the present invention scrolling through a blurred paytable 86 until reaching the section containing the letter Referring now to FIGS. 10A through 10E, a fourth paytable embodiment is shown, wherein a paytable display includes less than all information for all the symbols. In this embodiment, the game maintains a plurality of paytables having different types of information on all the symbols. For example, FIG. 10A illustrates a fragmentary view (symbols "K," "L" and "M") of the paytable 88 which includes only base game pay information 66 for all the symbols. FIG. 10B illustrates a fragmentary view (symbols "K," "L" and "M") of the paytable 90 which includes only bonus round information 68 for all symbols. FIG. 10C illustrates a fragmentary view (symbols "K," "L" and "M") of the paytable 92 which includes only multiplier information 70 for all the symbols. FIG. 10D illustrates a fragmentary view (symbols "K," "L" and "M") of the paytable 94 which includes only substitute information 72 for all the symbols. FIG. 10E illustrates a fragmentary view (symbols "K," "L" and "M") of the paytable 96 which includes only scatter information 74 for all the symbols.

The embodiment illustrated by FIGS. 10A through 10E is not limited to displaying only one type of information on a single paytable display as discussed above with respect to FIGS. 8A through 8E. Each type of information, however, is preferably displayed in one or the displays. As discussed with FIG. 9, the paytable displays 88, 90, 92, 94 and 96 each contain paytable information for every symbol of gaming device 10. The game immediately scrolls to and displays the desired section of the paytable, shown here as the symbol "L".

The displays only preferably contain the desired information, e.g., the symbol "L", but can alternatively additionally display a portion or all of the information for neighboring symbols. The symbols "K" and "M" are shown to illustrate that the paytables contain information on more than one symbol. The game can immediately display paytable information for the symbol "L" or provide a desirable effect, such as scrolling through a blurred paytable before reaching the desired symbol.

Negotiating Through Multiple Paytable Displays

It should be appreciated that the paytable embodiments of FIGS. 8A to 8E and 10A to 10E have at least two paytable displays and require a method by which the user can call forth or access a desired type of information. It should also be appreciated that negotiating through multiple displays of the present invention, wherein each display contains information concerning a symbol for which the player desires information is much less taxing and time wasting then negotiating through display after display of non-desirable information.

Figure 11:
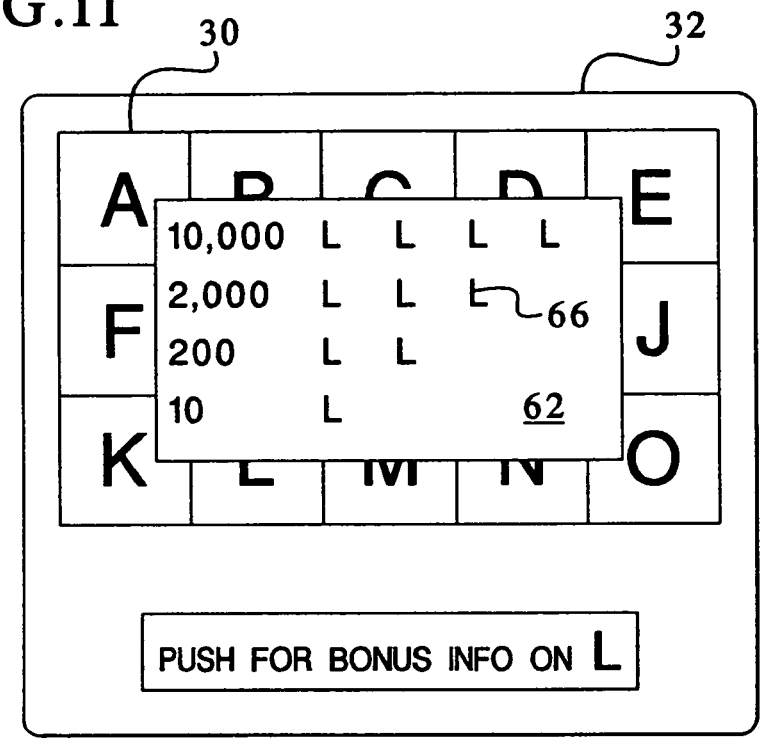
FIG. 11 is a front elevational view of the paytable display illustrating a scrolling method of selecting different paytable displays.

Referring now to FIG. 11, the paytable display 62 (shown earlier in FIG. 6) has a scrolling method for selecting different paytable displays. In particular, the gaming device 10 preferably provides a single selector 98, which can be an area of a touch screen 46 adapted to send an input to the controller or an external input device 33 mounted on the panel of the gaming device 10. The controller and the selector 98 are preferably adapted so that the player can select the button and scroll to the next paytable of the selected symbol.

FIG. 11 illustrates the paytable 62 having base game pay information 66. The game preferably provides a suitable message, on the selector 98 or elsewhere, such as a specific one, "push for bonus information on the symbol 'L'" or a general one, "select for more information". When the player selects the selector 98, the game displays the paytable display 62 having bonus round information 68 (i.e., different information), and switches the message, if specific, to a prompt for another type of information. The player can proceed in this manner to access all the types of information for the symbol. The scrolling method illustrated by FIG. 11 applies to both the single symbol paytable embodiment illustrated by FIG. 8 and the "all symbols" paytable embodiment of FIG. 10.

Figure 12:
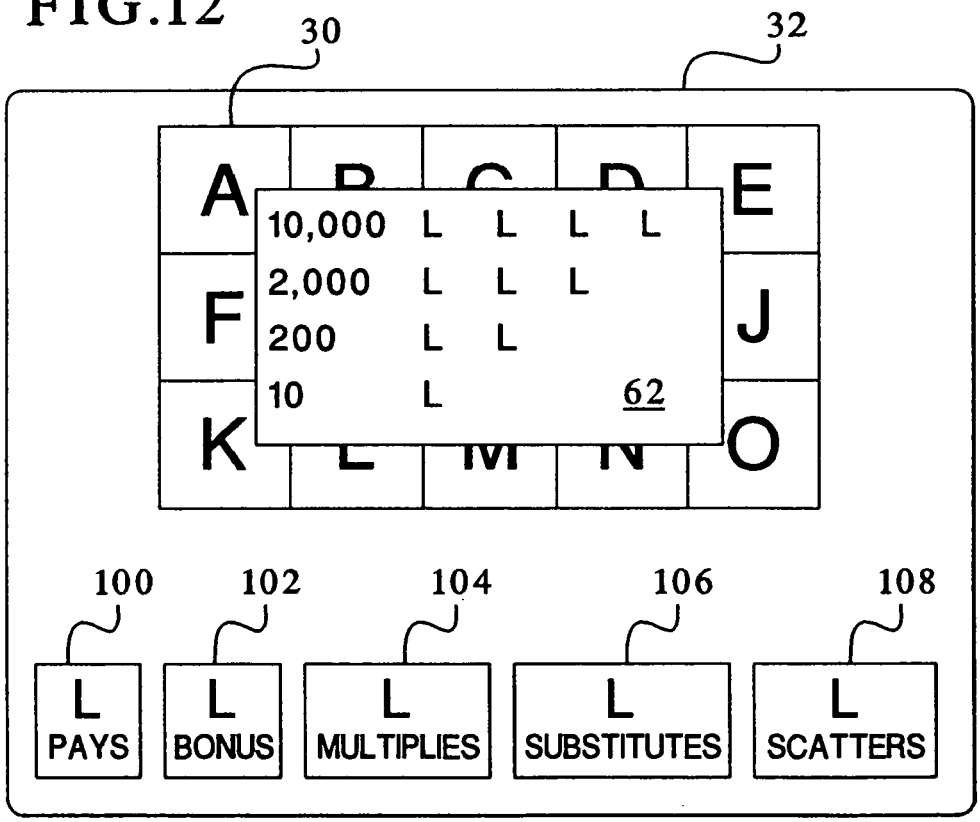
FIG. 12 is a front elevational view of the paytable display illustrating an individual selector method of selecting different paytable displays.

Referring to FIG. 12 a front elevation view of the paytable display 62 is shown illustrating an individual selector method of selecting different paytable displays. In this method, the gaming device 10 preferably provides a different selector for each paytable display. FIG. 12 illustrates a selector 100 to for displaying a base game pay 66 paytable; the selector 102 for displaying a bonus round information 68 paytable; the selector 104 for displaying a multiplier information 70 paytable; the selector 106 for displaying a substitute information 72 paytable; and the selector 108 for displaying a scatter pay information 74 paytable. It should be appreciated that the present invention provides suitably marked selectors for paytables having a plurality of the above or other types of paytable information.

Each of the selectors can be an area of a touch screen 46 adapted to send an input to the controller or an external input device 33 mounted on the panel of the gaming device 10. After choosing a desired symbol, the player selects the selector corresponding to the type of information desired. The individual selector method applies to both the single symbol paytable embodiment illustrated by FIG. 8 and the "all symbols" paytable embodiment of FIG. 10.

Another method contemplated by the present invention for enabling a player to view each paytable display containing one or more types of paytable information includes adapting the controller to sequentially scroll through the various paytable displays or pertinent portions of the paytable displays. The controller displays, for example, a paytable display (or area thereof) containing desired base game pay information 66, bonus round information 68 and multiplier information 70 for five seconds. The controller then displays a paytable display (or area thereof) containing desired substitute information 72 and scatter pay information 74 for three seconds.

The implementor can set the time of each paytable display of a sequence for any amount of time. The time preferably enables the player to comfortably view the display, but does not delay the normal operation of the game. It is well known in the art to set a timer or otherwise programmably create a sequence of events. The sequencing method requires no extra simulated or electromechanical input device. The sequencing method also applies to both the single symbol paytable embodiment illustrated by FIGS. 8A through 8E and the "all symbols" paytable embodiment illustrated by FIGS. 10A through 10E.

It should be appreciated that in the player selectable embodiments, the player can use the same symbol activation device or method or a different device or method to return to the symbol display. In the sequencing method, the game can automatically return to the symbol display. Alternatively, the sequencing method can provide a suitable selector that enables the player to interrupt the sequence and immediately return to the symbol display.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device operated under control of at least one processor, said gaming device comprising:

a display device controlled by the processor;

a game controlled by the processor and operable upon a wager, said game including at least one symbol generator, said at least one symbol generator configured to generate a plurality of symbols including a plurality of different symbols;

at least one player input device activatable to select at least one of said symbols, wherein when the player input device is activated by a player to select one of the symbols, the player input device is configured to initiate sending a signal to the processor to communicate a player selection of said symbol to the processor; and a plurality of different paytable displays associated with the plurality of different symbols and stored in a memory device accessible by the processor, wherein if the processor receives the signal communicating the player selection of one of said symbols, said processor causes said display device to display the paytable display for said selected symbol.

2. The gaming device of claim 1, wherein the at least one symbol generator includes at least one reel.

3. The gaming device of claim 1, wherein the game includes a plurality of symbol generators, said symbol generators configured to generate a plurality of the different symbols.

4. The gaming device of claim 1, wherein said at least one player input device includes a touch screen.

5. The gaming device of claim 1, wherein the processor is configured to cause the display device to display the paytable display for said selected symbol at a position of at least part of the at least one symbol generator.

6. The gaming device of claim 1, wherein the game includes a plurality of symbol generators and the selected symbol is associated with one of said symbol generators, wherein the processor is configured to cause the display device to display the paytable display for said selected symbol at a position of at least part of another one of said symbol generators.

7. The gaming device of claim 1, wherein a plurality of the different symbols have different functions in the game and the paytable displays associated with said different symbols are different.

8. The gaming device of claim 1, wherein at least one of the different symbols has a plurality of associated paytable displays, wherein if the processor receives a signal communicating the player selection of said at least one different symbol, said processor is configured to cause said display device to sequentially display said paytable displays for said selected at least one different symbol.

9. The gaming device of claim 1, wherein the paytable displays each include payout information for combinations of the symbol associated with said paytable display.

10. The gaming device of claim 1, wherein one of said paytable displays includes at least one of:

(a) bonus triggering information for the symbol associated with said paytable display;

(b) substitute information for the symbol associated with said paytable display;

(c) scatter pay information for the symbol associated with said paytable display;

(d) multiplier information for the symbol associated with said paytable display; and (e) payout information for the symbol associated with said paytable display.

11. A gaming device operated under control of at least one processor, said gaming device comprising:

a game controlled by the processor and operable upon a wager, said game including a plurality of symbol generators;

a plurality of symbols on said symbol generators, said plurality of symbols including a plurality of different symbols;

a display device operable to display said symbol generators and said symbols;

a touch screen connected to the display device; and a plurality of paytable displays for said different symbols, wherein a plurality of the different symbols have different functions in the game and the paytable displays associated with said different symbols are different, and wherein the processor is programmed to cause the display device to display the paytable display for a selected one of the different symbols if said symbol is selected by a player using the touch screen.

12. The gaming device of claim 11, wherein the processor is programmed to cause the display device to display the paytable display for said selected symbol at a position of at least part of the symbol generator having the selected symbol.

13. The gaming device of claim 11, wherein the selected symbol is associated with one of said symbol generators and the processor is programmed to cause the display device to display the paytable display for said selected symbol at a position of at least part of another one of said symbol generators.

14. The gaming device of claim 11, wherein at least one of the different symbols has a plurality of associated paytable displays, wherein the processor is programmed to cause the display device to sequentially display said paytable displays for said symbol if said symbol is selected by the player using the touch screen.

15. The gaming device of claim 11, wherein said paytable displays each include payout information for combinations of the symbol associated with said paytable display.

16. The gaming device of claim 11, wherein one of said paytable displays includes at least one of:

(a) bonus triggering information for the symbol associated with said paytable display;

(b) substitute information for the symbol associated with said paytable display;

(c) scatter pay information for the symbol associated with said paytable display;

(d) multiplier information for the symbol associated with said paytable display; and (e) payout information for the symbol associated with said paytable display.

17. A gaming device operated under control of at least one processor, said gaming device comprising:

a game controlled by the processor and operable upon a wager, said game including a plurality of symbol generators;

a plurality of symbols on said symbol generators, said plurality of symbols including a plurality of different symbols;

a paytable associated with said symbols based on the functionality of the symbols in the game;

a symbol selector; and a display device, wherein the processor is programmed to, upon player selection of one of said symbols using the symbol selector, cause said display device to display a portion of the paytable associated with said selected symbol.

18. The gaming device of claim 17, wherein the symbol generators includes at least one reel.

19. The gaming device of claim 17, wherein said symbol selector includes a touch screen.

20. The gaming device of claim 17, wherein a plurality of the different symbols have different functions in the game and the portions of the paytable associated with said different symbols are different.

21. The gaming device of claim 17, wherein at least one of the different symbols has a plurality of associated portions of the paytable, wherein the processor is programmed to, upon the player selection of said symbol using the symbol selector, cause said display device to sequentially display said portions of the paytable associated with said symbol.

22. The gaming device of claim 17, wherein said portions of said paytable each include payout information for combinations of the symbol associated with said portion of the paytable.

23. The gaming device of claim 17, wherein one of said portions of the paytable includes at least one of:

(a) bonus triggering information for the symbol associated with said portion of the paytable;

(b) substitute information for the symbol associated with said portion of the paytable;

(c) scatter pay information for the symbol associated with said portion of the paytable;

(d) multiplier information for the symbol associated with said portion of the paytable; and (e) payout information for the symbol associated with said portion of the paytable.

24. The gaming device of claim 17, wherein the processor is programmed to cause the display device to display the paytable display for said selected symbol at a position of at least part of the symbol generator having the selected symbol.

25. The gaming device of claim 17, wherein the selected symbol is associated with one of the symbol generators and the processor is programmed to cause the display device to display the paytable display for said selected symbol at a position of at least part of another one of the symbol generators.

26. A gaming device operated under control of at least one processor, said gaming device comprising:

a game controlled by the processor and operable upon a wager by a player;

a plurality of symbol generators in the game, said symbol generators including a plurality of symbols, said symbols including a plurality of different symbols;

a plurality of different winning combinations of said symbols obtainable in said game;

a plurality of awards including a plurality of different awards obtainable in said game, each award resulting from at least one of said different winning combinations of symbols which can be generated by the symbol generators;

a symbol selection input device; and a display device, wherein upon the player selecting one of said symbols using the symbol selection input device, the processor causes the display device to display paytable information indicating the winning combinations that include said symbol and the obtainable awards for at least one of said winning combinations.

27. The gaming device of claim 26, wherein the symbol generators includes at least one reel.

28. The gaming device of claim 26, wherein said symbol selection input device includes a touch screen.

29. The gaming device of claim 26, wherein a plurality of the different symbols have different functions in the game and the winning combinations associated with said different symbols are different.

30. The gaming device of claim 26, wherein a plurality of the different symbols have different functions in the game and the awards associated with said different symbols are different.

31. The gaming device of claim 26, wherein a plurality of the different symbols have different functions in the game and the winning combinations and awards associated with said different symbols are different.

32. The gaming device of claim 26, wherein upon the player selecting one of said symbols using the symbol selection input device, the processor causes the display device to sequentially display the information of the winning combinations of said symbol and the obtainable award associated with each said winning combination.

33. The gaming device of claim 26, wherein one of said winning combinations for at least one of the symbols includes at least one of:

(a) bonus triggering information for the symbol;

(b) substitute information for the symbol;

(c) scatter pay information for the symbol;

(d) multiplier information for the symbol; and (e) payout information for the symbol.

34. The gaming device of claim 26, wherein the processor is programmed to cause the display device to display the information on the winning combinations that include said symbol and the obtainable awards for said winning combinations at a position of at least part of the symbol generator having the selected symbol.

35. The gaming device of claim 26, wherein the selected symbol is associated with one of the symbol generators and the processor is programmed to cause the display device to display the information on the winning combinations for said selected symbol and the obtainable awards for said winning combinations at a position of at least part of another one of the symbol generators.

36. A method of operating a gaming device having a game operable upon a wager, said method comprising:

displaying a plurality of symbol generators of the game and a plurality of symbols on the symbol generators; and in response to an input from a player selecting one of the symbols, displaying on an electronic display device at least a portion of a paytable associated with said selected symbol for a subsequent play of the game, wherein said portion of said paytable includes:

(i) at least one winning combination of symbols that includes said selected symbol, and (ii) at least one award associated with each said winning combination.

37. The method of claim 36, wherein the portion of the paytable associated with each symbol includes all winning combinations that include said symbol.

38. The method of claim 36, wherein the portion of the paytable associated with each symbol includes all awards associated with the winning combinations that include said symbol.

39. The method of claim 36, wherein the portion of the paytable associated with each symbol includes all winning combinations that include said symbol and all awards associated with the winning combinations that include said symbol.

40. The method of claim 36, which includes sequentially displaying, upon receipt of input from a player selecting one of the symbols, a plurality of portions of the paytable associated with said symbol.

41. The method of claim 36, which includes displaying the portion of the paytable associated with said selected symbol at a position of at least part of the symbol generator having the selected symbol.

42. The method of claim 36, wherein the selected symbol is associated with one of the symbol generators, the method including displaying the portion of the paytable associated with said selected symbol at a position of at least part of another one of the symbol generators.

* * * * *